US010663114B2

(12) United States Patent
Luparello

(10) Patent No.: US 10,663,114 B2
(45) Date of Patent: May 26, 2020

(54) NATURAL GAS HOME FAST FILL REFUELING STATION

(71) Applicant: Michael J. Luparello, Lakewood, CA (US)

(72) Inventor: Michael J. Luparello, Lakewood, CA (US)

( * ) Notice: Subject to any disclaimer, the term of this patent is extended or adjusted under 35 U.S.C. 154(b) by 168 days.

(21) Appl. No.: 15/731,691

(22) Filed: Jul. 17, 2017

(65) Prior Publication Data

US 2017/0321845 A1 Nov. 9, 2017

Related U.S. Application Data

(63) Continuation-in-part of application No. 13/677,560, filed on Nov. 15, 2012, now abandoned.

(51) Int. Cl.

| | |
|---|---|
| ***F17C 5/00*** | (2006.01) |
| ***F17C 5/06*** | (2006.01) |
| ***F04B 15/08*** | (2006.01) |

(52) U.S. Cl.

CPC ..... *F17C 5/007* (2013.01); *F04B 15/08* (2013.01); *F17C 5/06* (2013.01); *F04B 2205/05* (2013.01); *F17C 2201/0109* (2013.01); *F17C 2201/056* (2013.01); *F17C 2203/0617* (2013.01); *F17C 2203/0639* (2013.01); *F17C 2205/0142* (2013.01); *F17C 2205/0326* (2013.01); *F17C 2205/0329* (2013.01); *F17C 2205/0332* (2013.01); *F17C 2205/0335* (2013.01); *F17C 2205/0338* (2013.01); *F17C 2205/0341* (2013.01); *F17C 2221/033* (2013.01); *F17C 2223/0123* (2013.01); *F17C 2223/033* (2013.01); *F17C 2225/0123* (2013.01); *F17C 2225/036* (2013.01); *F17C 2227/0157* (2013.01); *F17C 2250/01* (2013.01);

(Continued)

(58) Field of Classification Search

CPC ..... F17C 5/06; F17C 5/007; F17C 2221/033; F17C 2221/0123; F17C 2225/0123; F17C 2265/065; F04B 2205/05

See application file for complete search history.

(56) References Cited

U.S. PATENT DOCUMENTS

| | | | | |
|---|---|---|---|---|
| 1,885,329 | A * | 11/1932 | Cherdron | E04B 1/24 52/404.1 |
| 2013/0248000 | A1* | 9/2013 | Killeen | F17D 3/00 137/14 |

(Continued)

OTHER PUBLICATIONS

"Alkin W31 mariner compressor" video, published on youtube on Aug. 17, 2015, https://www.youtube.com/watch?v=UfHumCbzMXU.*

*Primary Examiner* — Andrew D Stclair
(74) *Attorney, Agent, or Firm* — John R. Ross

(57) ABSTRACT

A home-based, low-cost, self-contained, fast-fill natural gas refueling station for providing compress natural gas (CNG) fuel for motor vehicles. The station compresses utility supplied natural gas and stores the CNG in a CNG storage facility located inside the station. In preferred embodiments the refueling station is located adjacent to a driveway at a home. The compressor preferably is a multi-stage gas compressor having at least three stages of compression. Applicant estimates that savings based today prices for CNG as compared to gasoline, a typical family with only one car could pay for the station in three years. If the family has several cars the station could pay for itself much earlier.

7 Claims, 2 Drawing Sheets

(52) U.S. Cl.
CPC .. *F17C 2250/032* (2013.01); *F17C 2250/043* (2013.01); *F17C 2250/075* (2013.01); *F17C 2265/01* (2013.01); *F17C 2265/065* (2013.01); *F17C 2270/0139* (2013.01); *F17C 2270/0168* (2013.01); *F17C 2270/07* (2013.01)

(56) References Cited

U.S. PATENT DOCUMENTS

| | | | | |
|---|---|---|---|---|
| 2014/0102587 | A1* | 4/2014 | Nagura | H01M 8/04208 141/69 |
| 2014/0130938 | A1* | 5/2014 | Luparello | F17C 5/007 141/69 |
| 2015/0013829 | A1* | 1/2015 | Kuehl | F17O 5/06 141/4 |

* cited by examiner

NATURAL GAS HOME FAST FILL REFUELING STATION

CROSS REFERENCE TO RELATED APPLICATION

The Utility patent application a Continuation in Part of Ser. No. 13/677,560, filed Nov. 15, 2012 which is hereby incorporated by reference herein.

FIELD OF THE INVENTION

The present invention relates to refueling stations and in particular to natural gas refueling stations.

BACKGROUND OF THE INVENTION

Natural Gas

Natural gas is a naturally occurring hydrocarbon gas mixture consisting primarily of methane, but commonly including varying amounts of other higher alkanes, and sometimes a small percentage of carbon dioxide, nitrogen, hydrogen sulfide, or helium. It is formed when layers of decomposing plant and animal matter are exposed to intense heat and pressure under the surface of the Earth over millions of years. The energy that the plants originally obtained from the sun is stored in the form of chemical bonds in the gas.

Natural gas is a fossil fuel used as a source of energy for heating, cooking, and electricity generation. It is also used as fuel for vehicles and as a chemical feedstock in the manufacture of plastics and other commercially important organic chemicals. Fossil fuel based natural gas is a non-renewable resource There are many reasons why natural gas makes an excellent automobile fuel. There is an abundance of natural gas available right here in the United States of America. Some say we have 500 years of it, and that means we can be supporting our own country for centuries instead of buying foreign oil from our enemies. Natural gas is also cleaner burning than gasoline or diesel. It's even more environmentally "green" than an electric vehicle, because half of the nation's electricity is generated by burning coal. Also, a natural gas car can be easily and quickly refilled at a filling station while an electric car would take hours to recharge. Natural gas is also a much less expensive fuel than gasoline. Finally, natural gas is safer than gasoline because if a fuel spill occurs, the fuel is a low-density gas that will float up and away instead of pooling on the ground, much safer in case of a fire.

Gasoline Gallon Equivalent

Gasoline gallon equivalent (GGE) or gasoline-equivalent gallon (GEG) is the amount of alternative fuel it takes to equal the energy content of one liquid gallon of gasoline. In 1994, the US National Institute of Standards and Technology (NIST) defined "gasoline gallon equivalent (GGE) means 5.660 pounds of natural gas." Compressed natural gas can be measured by its volume in standard cubic feet (volume at atmospheric conditions), by its weight in pounds or by its energy content in joules or British thermal units (BTU) or kilowatt-hours. It is difficult to compare the cost of gasoline with other fuels if they are sold in different units. GGE solves this. One GGE of CNG has exactly the same energy content as one gallon of gasoline. CNG sold at filling stations in the US is priced in dollars per GGE.

One GGE of natural gas is 126.67 cubic feet (3.587 $m^3$) at standard conditions. This volume of natural gas has the same energy content as one US gallon of gasoline (based on lower heating values: 900 BTU/cu ft of natural gas and 115,000 BTU/gal of gasoline). The National Conference of Weights & Measurements (NCWM) has developed a standard unit of measurement for compressed natural gas, defined in the NIST Handbook 44 Appendix D as follows: "1 Gasoline [US] gallon equivalent (GGE) means 2.567 kg (5.660 lb) of natural gas." When consumers refuel their CNG vehicles in the USA, the CNG is usually measured and sold in GGE units. This is helpful as a comparison to gallons of gasoline.

There are currently two types of natural gas filling stations. Public gas stations located away from the drivers' homes are "fast fill" stations, where a car tank can be filled in a few minutes, similar to the time it takes to fill the gasoline tank of a conventional car. These commercial fast fill stations have large noisy compressors and large storage tanks, and they are few and far between. Currently the natural gas home filling stations available utilize a slow compressor directly filling the car tank and can take many hours to fill the car. As a consequence, most home owners who utilize this "slow fill" method will fill their cars up overnight while hoping that the compressor noise does not interfere with their sleep or their neighbors sleep.

K Bottles

K bottles are known. They are used for storage of compressed gasses. The K bottle has an internal volume of 1.76 cubic feet. The below table shows the specifications for a K bottle:

| Cylinder | Nominal Dimensions[1] | Nominal Tare Weight | Water Capacity | Internal Volume Nominal @ 70° F., 1 ATM | | DOT |
|---|---|---|---|---|---|---|
| Size | Dia × Lgth, in | lbs. | lbs. | Liters | Cubic Feet | Specifications |
| K | 9¼ × 60 | 135 | 110 | 49.9 | 1.76 | 3AA2400 |

What is needed is a better home based natural gas refueling station.

SUMMARY OF THE INVENTION

The present invention provides a low-cost, home-based, self-contained, fast-fill compressed natural gas refueling station for providing natural gas fuel for one or more motor vehicles. The compressor is preferably a low-cost compressor, low-power compressor designed to increase the pressure in the natural gas storage facility from about 3,000 psi or 3,600 psi to about 4,500 psi in less than 12 hours. The station includes a fill hose connected to the storage facility having a fill nozzle designed to attach to—compressed natural gas storage tanks in motor vehicles. In a preferred embodiment a home owner or his contractor provides a prepared concrete pad furnished with electric power and gas lines from the home and all of the components of the station are contained in a shed which is delivered to the home fully assembled and ready of refill storage tanks of CNG cars when bolted to the prepared concrete pad and attached to gas line and electric power line located in the prepared pad. The pad should be close enough to the driveway so that cars can be refueled while parked on the driveway. Preferred embodiments of the present invention may include one or more of the following features:

In some preferred embodiments the low-cost, home-based, self-contained, fast-fill compressed natural gas refueling station is located adjacent to a driveway at a home, but at least five feet from the home itself. The natural gas supply source in preferred embodiments is the same natural gas source providing natural gas for home heating or natural gas appliances. The compressor preferably is a multi-stage gas compressor having at least three stages of compression.

The natural gas storage facility may be a natural gas storage tank array comprising a plurality of natural gas storage tanks providing a total storage volume approximately three times the volume of a typical compressed natural gas vehicle storage tank. So assuming a capacity of 8 GGE's for the typical vehicle tank the storage capacity could be 24 GGE's. (One GGE of natural gas is 126.67 cubic feet at standard conditions.) The storage facility could also be a single tank with similar capacity, such as a single spherical storage tank. It is unlikely that a capacity of more than 48 GGE's will be needed for more than a very few homes. The array of tanks may be commonly connected so as to simultaneously receive compressed natural gas from the multi-stage compressor, a check valve positioned between the multi-stage compressor and the natural gas storage tank array prevents backflow of compressed natural gas from the natural gas storage tank array through the multi-stage compressor into the home. A pressurized natural gas storage tank exit line connected to the storage tank array so as to convey compressed natural gas, from all of the storage tanks in the storage tank array, to the vehicle compressed natural gas tank to compress the vehicle tank to about 3,000 psi or about 3,600 psi. A compressed natural gas fill nozzle connected to the exit line is adapted to provide a sealed connection to the vehicle compressed natural gas tank.

A control system for opening and closing solenoid valves, a first seal testing solenoid valve, a second seal testing solenoid valve and a pressure transducer configured to measure compressed gas pressure at the natural gas fill nozzle for testing seals between the fill nozzle and the vehicle compressed natural gas tanks. Preferably the control system is programmed so that during the start of each process of dispensing gas to a vehicle, the control system will open the first seal testing solenoid valve to let a small amount of compressed gas to fill the space between the first and second seal testing solenoid valves, then the control system will close the first seal testing solenoid valve and open the second seal testing solenoid valve to permit compressed gas filling the space between the first and second seal testing solenoid valves to expand fill space in the exit line and the nozzle between the first seal testing solenoid valve and the vehicle storage tanks. Preferably the seal testing pressure transducer will send signals to the control system to check, for each vehicle at each refueling, the seal between the compressed natural gas fill nozzle and the vehicle storage tanks.

A water trap having a T section and a vertical drain pipe below the T section positioned at a low spot in compressed gas piping upstream of the storage tank array for keeping excessive moisture from the storage tank array. The water trap may have an upper solenoid valve and a lower solenoid valve next to each other in series wherein the control system is programmed so that, during the start of each process of dispensing gas to a car; the control system may open the upper solenoid valve then close it, then open the lower solenoid valve then close it, to permit a small amount of high pressure gas along with any water trapped between the upper and lower solenoid valves to be automatically ejected from the drain pipe.

Preferred embodiments also include a sound-proofed, weather-proofed, lockable shed large enough to house, and housing, the array of storage tanks, the compressor and the control equipment. In preferred embodiments all of the components are included in the shed which is delivered to the home ready to operate once connected to a gas line and to electric power at the home. Preferably a concrete pad with a gas line connected to the home gas supply and an electric power from the home circuit breaker panel is provided by the home owner close enough to the driveway so that a car on the driveway can be filled with compressed natural gas through the compressed natural gas fill nozzle. The shed can then preferably be bolted to the pad with the bolts located inside the lockable shed. Applicant expects to license his invention to an organization that will mass produce the stations so they can be marketed at a cost between $5,000 to $10,000 and sold through distributors such as Sears, natural gas automobile dealers, natural gas utility companies.

In preferred embodiments the compressor is shut off during the refueling process. The storage tanks may be connected in series or parallel or both series and parallel. The station may include a selector switch allowing a user to select a desired pressure level in which to refuel the vehicle, such as between 3000 psi and 3600 psi.

DETAILED DESCRIPTION OF THE PREFERRED EMBODIMENTS

Figure 1:
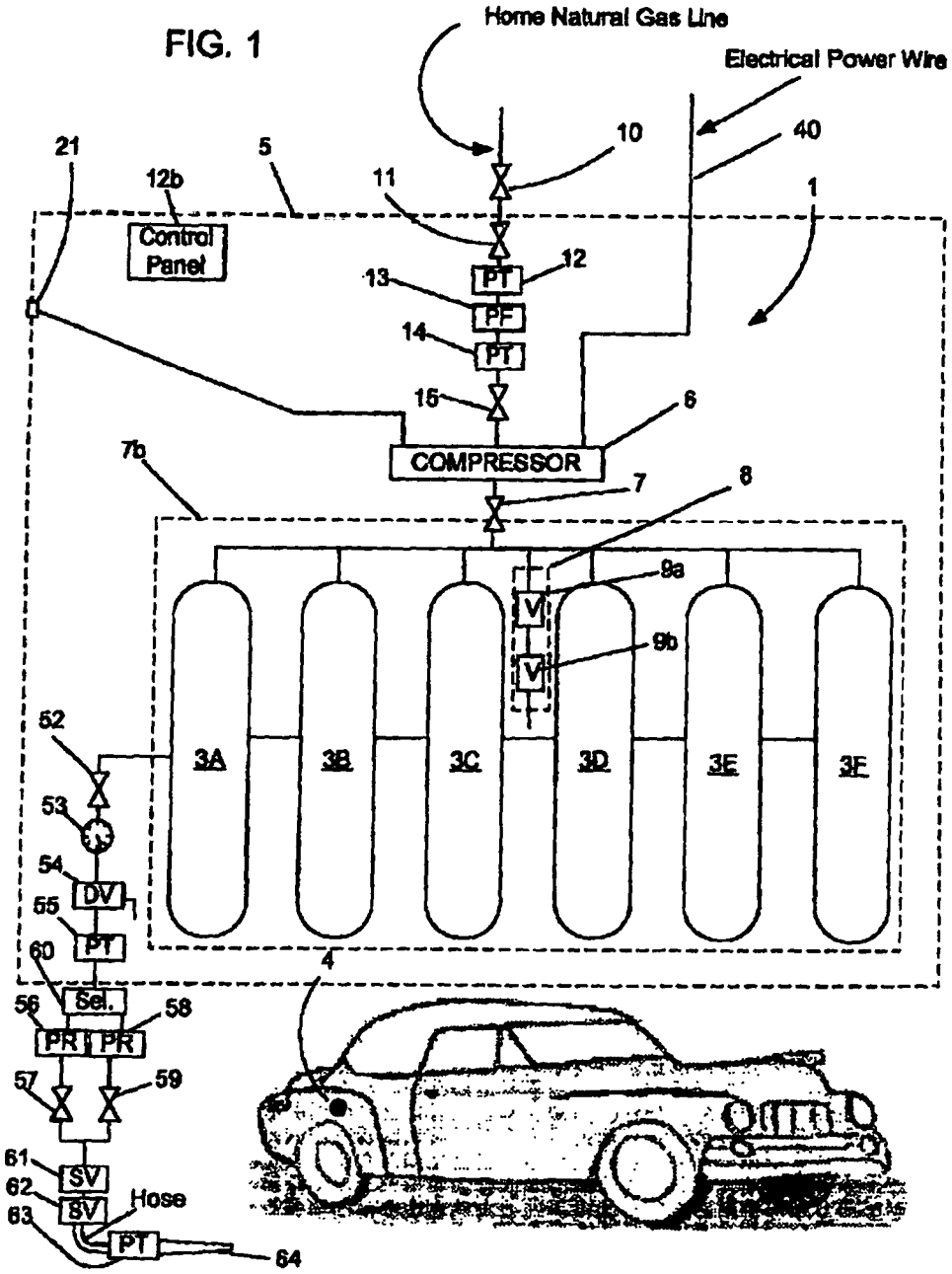
FIG. 1 which was FIG. 1 in Applicant's parent patent application shows important components of a preferred embodiment of the present invention.
Figure 2:
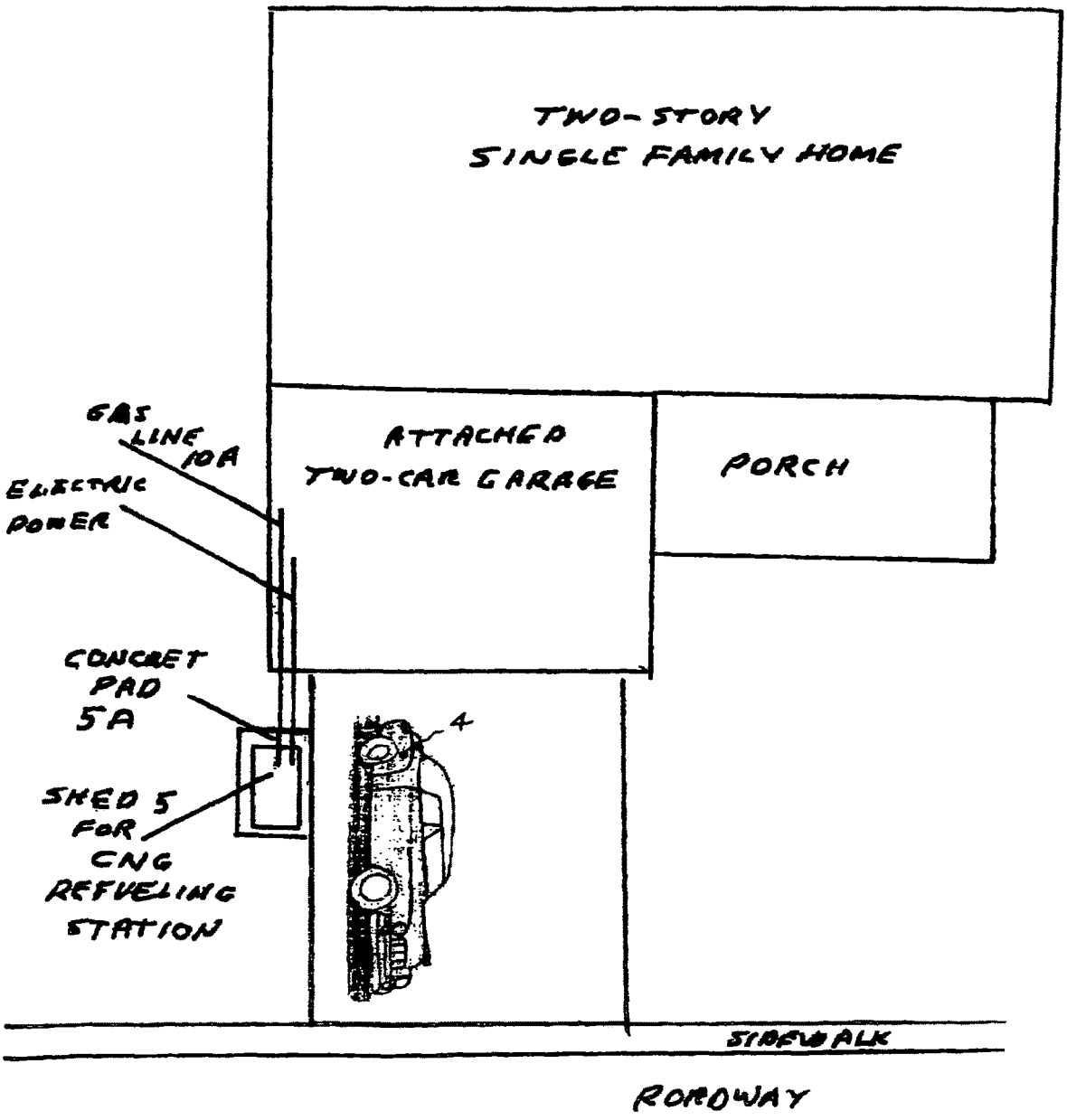
FIG. 2 shows the shed containing a home-based natural gas fueling station located next to a driveway and a home-owner fueling his natural gas powered car parked on his driveway.

A preferred embodiment of the present invention is a home-based fast-fill, self-contained compressed natural gas (CNG) refueling station designed for rapidly refilling a natural gas powered vehicle. The unit preferably includes an automatic multi-stage compressor, a storage tank and a fill nozzle, along with other control and safety components. Preferably all of the components of the station are contained in a shed bolted to a concrete pad located beside the driveway of a home of a resident or residents that own one or more natural gas powered motor vehicles.

In a preferred embodiment, the home natural gas line connects to manual shutoff valve 10. Manual shutoff valve 10 is followed by earthquake valve 11 to shut off the gas in the event of a strong earthquake. Pressure transducer 12 functions to send source pressure information to the control panel 12*b*. Particulate filter 13 functions to trap small particles that might interfere with the proper function of check valves, pressure relief valves, pressure regulators and the compressor. Pressure transducer 14 detects excessive pressure drop across the filter 13 if it is clogged. Pressure relief valve 15 is preferably set slightly above the supply pressure to protect the house against overpressure from backflow leakage and protect compressor 6 from excessive supply pressure. Multi-stage compressor 6 is capable of compressing natural gas from atmospheric pressure to at least 4500 psi. Check valve 7 prevents back flow from storage tank array 7*b* back through compressor 6 into the house.

Water trap 8 keeps excessive moisture from storage tank array 7*b*. Preferably water trap 8 empties automatically. Water trap 8 preferably is a low spot in the piping with a T intersection and a section of vertical pipe below connected to the branch of the T. If any water condenses during the compression of the natural gas, it will collect in this vertical drainpipe below the T intersection. The vertical pipe includes two solenoid valves 9*a* and 9*b* next to each other in series. During the start of the process of dispensing gas into the car, the control system will open the upper solenoid valve 9*a*, then close it, then open the lower solenoid valve 9*b* and then close it. A small amount of high pressure gas along with any water in the water trap will be automatically ejected out the bottom of the vertical pipe by this procedure. These solenoids are wired into the same control system that operates the two nozzle solenoids 61 and 62 (see discussion below). When nozzle solenoid valve 61 is energized to open and then shut, water trap solenoid valve 9*a* will also open and shut, and when nozzle solenoid valve 62 is energized to open and shut, water trap solenoid valve 9*b* will also open and shut. When the second switch on the control panel is turned on to dispense gas (open nozzle solenoid valves 61 and 62 simultaneously), water trap solenoid valves 9*a* and 9*b* will be disabled to keep them from opening.

Storage tank array 7*b* preferably includes several large steel tanks (3A-3F) similar to welding gas tanks. Pressure relief valve 52 set at about 5000 psi to protect the steel tanks (3A-3F) from exploding if the compressor malfunctions and stays on. Pressure gage 53 shows the pressure out of storage tank array 7*b*. Manual drain valve 54 is connected to an exhaust vent tube. Pressure transducer 55 senses the pressure in the storage tank array 7*b* and sends the information to control panel 12*b* to automatically turn the compressor on and off to maintain the desired storage tank pressure. Next we have a T fitting branching into two short parallel pipes. The left path preferably includes a 3000 psi pressure regulator 56 and pressure relief valve 57 set a few hundred psi above the regulator pressure at about 3400 psi. The right hand path preferably includes a 3600 psi pressure regulator 58 and a pressure relief valve 59 set 400 psi above at about 4000 psi. The left hand path is for vehicles to be filled to 3000 psi and the right hand path is for vehicles that can be filled to 3600 psi. These two paths connect to a switching valve called the nozzle pressure selector 60 which allows the operator to choose which pressure to use to fill the vehicle. Most new CNG vehicles have a maximum system pressure of 3600 psi but some older CNG vehicles are not designed to be pressurized above 3000 psi. For both of these paths, the pressure regulator reduces the high pressure from the storage tank down to the correct pressure for the vehicle. The pressure relief valves are to protect the vehicle from excessive pressure if the pressure regulator malfunctioned.

Electrically actuated solenoid valves 61 and 62 are used together to test the seal between the fill nozzle and the vehicle. The first valve 61 opens and closes to let a small amount of gas into the volume between the two valves. Then the second valve 62 opens to let this gas expand into the fill nozzle hose and up to the vehicle pressurizing the hose with a small amount of gas. If the gas remains for several seconds at the same pressure, this will indicate to the control panel that the nozzle has a sealed attachment to the vehicle and it is therefore safe to start filling the vehicle tank. The next component is another pressure transducer 63 which is used to detect the pressure in the fill nozzle during the safety seal check just mentioned, and also to indicate the pressure in the car tank when the fill operation is complete. The last component is the fill nozzle 64. This is the nozzle that attaches to and seals to the vehicle.

Normal Operation of the System

Preferably, a user attaches the fill nozzle 64 to the vehicle fill tube. Then the user flips a first electrical switch on control panel 12*b*. This disables the compressor and initiates the test procedure to make sure the fill nozzle is connected to the vehicle. The control panel 12*b* sequentially opens first nozzle solenoid valve 61, closes it, and then opens second nozzle solenoid valve 62. This procedure dispenses a small but significant amount of CNG into the fill hose and nozzle at about 100 psi. Under normal conditions, there will be an adequate seal and connection between the nozzle and the vehicle so that this test pressure in the nozzle will remain steady. The control system will check this for several seconds using the signal from pressure transducer 63. If the pressure holds steady, this means that there is a car connected to the nozzle and it is safe to dispense gas. The user can also verify this because the pressure readout from pressure transducer 63 will be visible on the control panel.

When the user is satisfied that the pressure is normal and holding, he flips a second switch or button on the control panel that will start the fill sequence by opening both solenoid valves 61 and 62 simultaneously. This will start a very rapid flow of CNG into the vehicle tank. The flow takes place because storage tank 7*b* pressure and the pressure regulator 56 or 58 is higher than the vehicle tank pressure. Flow will continue until one of two conditions is met. For a small or medium sized vehicle tank or partially filled vehicle tank, flow will continue until the vehicle tank pressure is full, that is the vehicle tank pressure is equal to the pressure of either pressure regulator 56 or 58. For a large vehicle tank or if the vehicle is being filled from a partially filled storage tank array 7*b*, the flow will continue with the vehicle tank pressure increasing and storage tank array 7*b* pressure decreasing until both pressures are the same. Because the gas is flowing under its own pressure without being pumped, the fill time does not depend on the speed of a compressor or pump and the entire fill process will be just as fast as at a public filling station. The operator can see the gas pressure readout on the control panel at the end of the fill process to see how full the vehicle tank is. At the conclusion of the fill process, the operator turns off the switches on the control panel to close solenoid valves 61 and 62. Then the nozzle is removed from the car and the process is complete. During this process, as soon as the gas started flowing and storage tank 7*b* started reducing in pressure, compressor 6 will want to start pumping. As a safety precaution, the control panel will not allow the compressor to run while the vehicle tank is being filled. At the conclusion of the fill process when the solenoid valves 61 and 62 are closed, the compressor will start and will continue to run until the pressure in the storage tank array 7*b* is once again at 4500 psi.

In a preferred embodiment, as a safety precaution, if the user turns on the second "fill" switch on the control panel without first turning on the first "test" switch, the fill solenoid valves 61 and 62 will not open.

Preferred Components of the Home Fast Filling Station

The following is a description of all major components in a preferred self-contained home-based CNG refueling station. They are described below in a logical order from a house gas supply connection, manual gas shutoff valve 10 to the hose fill nozzle 24 for filing the CNG storage tank of a motor vehicle.

Manual Gas Shutoff Valve

Manual gas shut off valve 10 is part of the gas line installed from the home. Home gas lines typically include shutoff valve installed at their end.

Earthquake Valve

Earthquake valve 11 is set to shut off the gas supply if there is any significant seismic activity. The device senses acceleration and closes isolating the filling station from the house gas supply. Preferably, it is also shuts off the gas in the event of an explosion or if the filling station gets hit by a car.

Pressure Transducer

Pressure transducer 12 measures the supply pressure at the upstream side of the filter 13. When compared to the downstream pressure, this will indicate to the control system when the filter needs to be replaced or if manual valve 10 or earthquake valve 11 is shut off.

Particulate Filter

Particulate filter 13 is a particle filter designed to trap particles and prevent them from getting into the other components. A spec of rust or other contamination from the gas supply pipe could otherwise possibly interfere with the operation of the one-way check valves, pressure regulators, pressure relief valves, or other sensitive components, and might cause premature wear of compressor components. This filter is upstream of any components with moving parts to protect them from contamination. Also filters are larger diameter than most of the other components which makes it harder to make them strong enough to withstand high pressures. By locating the filter here, a less expensive filter can be used that does not have to withstand high pressure.

Pressure Transducer

Pressure transducer 14 senses the pressure down-stream of the filter 13. The purpose is to detect any large pressure drop across the filter. If the filter gets clogged with contamination, the compressor will have a harder time sucking natural gas through the filter and this will lead to a pressure drop down-stream of the filter. If this happens, pressure transducer 14 will detect it and preferably will make a light turn on at control panel 12*b* indicating that the filter needs to be changed. This would also detect a closed manual shutoff valve or closed earthquake valve.

Pressure Relief Valve

Pressure relief valve 15 is preferably set at about 10 psi gage pressure (25 psi absolute). The inlet gas pressure from the house should never get above about 5 psi gage pressure so this pressure relief valve will normally never open. If pressure leaks backwards from the storage tanks through the compressor and the one-way check valve, then pressure relief valve 15 prevents the pressure from going back into the house, over pressurizing some natural gas appliance (like a furnace, water heater, stove, oven, drier, etc.) and possibly causing a fire or explosion in the house.

Pressure relief valve 15 also protects the filling station in the event that it is attached to a higher pressure commercial natural gas supply line. The compressor is designed to work with a low pressure house natural gas supply. Excessive inlet pressure will subject the beginning stages of the compressor to too much gas pressure and may cause compressor damage. The product directions will preferably state the limitation of the maximum allowable inlet pressure but in the event that limitation is ignored, this pressure relief valve will vent the excess pressure as soon as the gas manual valve is turned on and will be impossible to ignore.

Compressor

Compressor 6 is preferably a 3 or 4 stage compressor that pumps the natural gas from an initial pressure of about 15 psia (absolute pressure of 15 psi, gage pressure of 0.25 psi) to a final pressure of 4500 psi. This compressor can be relatively small but preferably is able to pump at the rate of at least 0.5 gallons per hour. The compressor will run to refill storage tanks 3A-3F after the car tank has been filled. Applicant expects his compressor will be similar to small scuba tank compressors such as the Alkin W31 Mariner 3.7 CFM 4500 PSI compressor available from Air Tanks Plus with offices in Sacramento, Calif. This particular compressor is a 3-stage compressor 4,500 PSI compressor and runs cool and quiet at only 1100 rpm and puts out 3.7 cfm and has a retail price of about $3,000.

Controls

Controls for the station can be provided with a low cost programmable logic relay such as a variety of TECO PLRs are available from suppliers such as B&B Electronics for prices in the range of $100 to $200. These devices can be easily programmed to perform all of the functions referred to in this specification.

Check Valve

Check Valve 7 is a one way valve that prevents gas from going from the tanks backwards through the compressor and back into the house. This is such a crucial device and relatively inexpensive, so that in a preferred embodiment, two are connected in series for redundancy and safety.

Water Trap

In a preferred embodiment, water trap 8 is located at the lowest spot in the piping with a T intersection and a section of vertical, downward directing pipe connected to the branch of the T. If any water condenses during the compression of the natural gas, it will collect in this downward directing drain pipe below the T. The vertical pipe will have two solenoid valves next to each other in a series gas connection. Water trap solenoid valves 9*a* and 9*b* are two electrically operated (on-off) valves that are placed next to each other on the low end of water trap 8. By opening and closing upper valve 9*a* and then opening and closing the lower valve 9*b* any water caught in the trap will be ejected from the system by a small amount of high pressure CNG. The controls described above may be programmed so that during the start of the process of dispensing gas into the car, upper solenoid valve 9*a* will open, then close, then lower solenoid valve 9*b* will also open and close. A small amount of high pressure gas along with any water in the system will be automatically ejected out the bottom of the vertical pipe by this procedure. Alternatively, the solenoid valves could be controlled manually with switches to periodically empty the trap. Another alternative is to replace the solenoid valve with manually operated valves which should decrease somewhat the cost of the station. Another solution is to add a moisture sensor and program the control system to check the moisture sensor and empty the water trap if it actually has water in it.

Storage Tanks

Storage tanks 3A-3F are large steel tanks (similar to welding gas tanks) attached together act as a single large tank 7*b*. In a prototype embodiment tanks 3A-3F are each a 4500 psi K bottle compressed gas storage tanks. Each of the six tanks, in this preferred embodiment, will hold about 4.25 GGE of compressed natural gas at a pressure of 4500 psi (for a total of 25.5 GGEs, equivalent to about 3,230 cubic feet of natural gas at standard pressure). These tanks may be filled up to a pressure of 4500 psi. The total volume of the tanks are preferably approximately three times the size of the typical vehicle storage tank (which is about 8 GGEs at 3600 psi) so that during the filling of an empty vehicle from close to zero pressure to 3425 psi, the storage tank pressures in the station will drop from 4500 psi to about 3425 psi. For the filling of a vehicle that would be normally not quite empty, the storage tanks will have more than enough pressure to completely fill the vehicle tank to 3600 psi. For example, during refueling, the gas quickly flows from the higher pressure storage tank 3A into car tank 4 allowing rapid refueling. As natural gas leaves tank 3A it is immediately replenished by pressurized gas in tanks 3B-3F. After refueling, compressor 2 will run for a few hours to re-pressurize storage tanks 3A-3F. The compressor and storage tanks are preferably housed in small weatherproof locking shed 5 that will typically be installed by the homeowner along one edge of the driveway.

If a family expects to need to refill at a rate of one car per day or less than one car per day their storage facility should provide a capacity of 24 GGE. If the family expects to need to fill more than one car per day, the family may want to increase the storage capacity. Most families will conclude that a capacity of 24 GGEs will be plenty of capacity. A large family may find that the members of the family will need to carefully schedule their refueling or in some case be satisfied with partial refuelings. Or they could purchase two stations or a station with larger capacities. Applicant does not expect to provide stations with capacities in excess of 48 GGEs.

Pressure Relief Valve

Pressure relief valve 52 will be set at about 5000 psi and will protect the tank from exploding if the compressor shut-off circuit stops working and the compressor runs continuously.

Pressure Gage

Pressure gage 53 shows the pressure in the storage tanks. The gauge should have a capacity of 6000 psi and will nominally read up to 4500 psi.

Manual Drain Valve

Drain valve 54 is located at the output of the storage tanks. Preferably drain valve 54 is attached to a T fitting and includes an exhaust vent pipe. Drain valve 54 is utilized if maintenance needs to be performed on the system. The natural gas supply may need to be turned off and the system may need to be drained through this manual drain.

Pressure Transducer

This pressure transducer 55 will sense the pressure in the tanks and will turn on compressor 6 when the tanks 3A-3F need more pressure. It will shut off compressor 6 when the tanks have 4500 psi.

Pressure Selector Switch

Pressure selector switch 60 is a switch that allows the user to select between 3000 psi and 3600 psi. Most newer CNG vehicles operated at a maximum rated pressure of 3600 psi but there are some older vehicles that run on 3000 psi.

3000 PSI Pressure Regulator and 3600 PSI Pressure Regulator

3000 PSI pressure regulator 56 and 3600 PSI pressure regulator 58 are preferably set at 3000 psi and 3600 PSI and are preferably in two parallel pipes. They both function to control the output pressure of the filling station to never be more than the car can withstand, so that the car is not over pressurized. The two pressure regulators are in parallel with selector switch 60 so that the user can switch between 3000 or 3600 psi gas pressure regulation depending upon the needs of the particular car being filled.

Pressure Relief Valves

Pressure relief valves 57 and 59 are preferably set at about 3400 psi (for the 3000 psi regulator) and 4000 psi (for the 3600 psi regulator) to guard against putting too much pressure into the car if the pressure regulator fails. A pressure regulator must be set to some pressure a little above the working pressure because they may start to leak a little near their set pressure.

It should be noted that in another preferred embodiment pressure relief valves 57 and 59 could be eliminated. In another embodiment, these components would not be necessary because even if the storage tanks were completely full they would only have 4500 psi. A car being refueled is capable of four times the working pressure of 3600 psi without having a rupture and the proof test is 1.5 times the working pressure. So the car proof pressure is 4500 psi and the car burst pressure is at least 14,400 psi. Since a failure of the regulator would only affect the filling of the car, it only becomes an issue at the last stage of the car refilling, where the storage tank pressure would not be much in excess of the 3600 psi and certainly much less than the 4500 psi original storage tank pressure. Therefore, in another embodiment pressure relief valves 57 and 59 could be eliminated and still be very safe.

First Nozzle Solenoid Valve

First nozzle solenoid valve 61 and second nozzle solenoid valve 62 are positioned in series right next to each other. They are located prior to the fill nozzle hose. The two solenoids and pressure transducer 63 function to check to see if the fill nozzle is correctly attached to the car so that there are no leaks. When a "test" button on control panel 12*b* is pushed, the upstream valve 61 opens to allow a small amount of 4500 psi gas to flow into the area between the valves. Then it closes. Then the downstream valve 62 opens to let this 4500 psi gas expand into the fill hose and nozzle to pressurize them to about 100 psi. Pressure transducer 63 monitors this pressure for a few seconds to make sure there are no leaks, and if the pressure stays constant for a few seconds then the control system lights up a second "fill" button on the control panel and enables the flow of high pressure gas into the car as soon as the fill button is pushed.

Second Nozzle Solenoid Valve

Second nozzle solenoid valve 62 works with first solenoid valve 61 to send a metered amount of test gas into the nozzle to test that the dispensing nozzle is sealed to the car fill tube. This must be verified before the control panel allows the fill process to take place. Otherwise there is a risk of spillage of a very large quantity of CNG and the possible high speed motion of the nozzle if it is not connected to the car.

Pressure Transducer

Pressure transducer 23 is positioned on the fill hose and sends an electrical signal to control panel 12*b* indicating the pressure in the fill hose. While fill nozzle 64 is connected to the car, this digital readout of the fill hose will indicate the pressure inside the car's tank, and it will be accurate near the end of the fill process when the gas flow rate reduces and eventually stops.

Fill Nozzle

Fill nozzle 64 is a commercially available fill nozzle from a supplier of CNG products.

Shed

Shed 5 preferably will be large enough to house the storage tank or tanks (such as the 6-pack of "K" bottles—welding tank size) and compressor 2 with sound proofing. Shed 5 preferably has a door that locks similar to a front door lock. Shed 5 will be preferably weather proof. Gas line 10 and electrical power wiring 40 for compressor 2 from the house will normally be brought to shed 5 underground and will come up through the floor of the shed so that all the gas and electrical connections are protected from the weather and hidden from view to minimize vandalism and improve aesthetics. Shed 5 is preferably fastened to the ground (preferably on a pre-poured concrete pad 5A) to prevent tip-over or theft and the shed will hold storage bottles 3A-3F firmly enough to prevent them from falling. If necessary, a gas meter will be included in the shed. Preferably the approximate minimum size is 2 feet wide by 4 feet long and 5 feet high. Small compressors can be somewhat nosey and may cause an issue with neighbors unless the noise is dealt with. The shed could be sound proofed and this may take care of the problem. Also, it may be preferable to arrange to put the compressor in a sound proofed shed located remote from the array of storage tanks (such as in the back yard of the home) and connect the array of tanks to a single storage tank located with the compressor with a thin stainless steel tube. In this case no sound proofing would be needed for the shed beside the driveway.

Advantages of a Home-Based CNG Station

There are many advantages of embodiments of this simple low cost home-based compressed natural gas refueling system. Being home based, the refueling stations embodiments on the present invention are designed to refuel cars owned by the home owner which would normally require about one to maybe seven refueling per week depending on the number of cars in the family. This means that the storage tanks at the station are designed to refuel only one car at a time. But the refueling of first car can be accomplished in less than one minute at the end of a work day. Then a tiny, low-cost, low-noise compressor can recharge the storage tanks overnight (in about eight hours) and a second car can be refueled in less than one minute the next morning. This way the station could easily handle 14 refuelings per week. With the eight-hour recharge schedule, the station could increase the number of refuelings to up to 21 refuelings per week. Other advantages of the present invention are that there is no need to monitor the amount of compressed natural gas dispensed by the station. And there is no need to be concerned about the cost or price of each refueling since the family is utilizing their own natural gas supplied to the family's home by their local natural gas utility company. Applicant estimates the price of a mass produced and fully installed system of the present invention designed for eight-hour recharging of the storage tanks will be a few thousand dollars probably about $5,000 to $10,000. Applicant's expert has just checked his gas bill for his home and gas currently costs 99.3 cents per therm which translates to 83 cents per equivalent gallon. So with regular gas going for about $2.50 per gallon he calculates that natural gas is about ⅓ the cost of gasoline. But a natural gas vehicle only holds about 8 equivalent gallons of natural gas and it may not be completely empty before you fill it. So if you put in 6 equivalent gallons of natural gas that does indeed show about $10 of savings over gasoline. But expressing it like that understates the real savings because people are used to putting 12 to 15 gallons of gasoline in their tank and spending $30.00 to $40.00 per fill-up. So it sounds like you only save about ⅓ to ¼ of the cost but actually you save ⅔ of the cost because a "fill-up" of a natural gas vehicle is so small. If a car fill-up is 15 gallons of gasoline, then instead of costing $37.5, the equivalent 15 gallons of natural gas would cost $12.45 for a savings of $25.05 per equivalent gasoline car fill-up. So there are two points here: the actual fuel cost is ⅓ as much and since the fuel tank is much smaller, the convenience of quickly filling your car at home is worth a lot. At say 25 mpg, a small car like the Honda Civic with an eight equivalent gallon tank can only go about 200 miles. A taxi driver or outside sales rep. probably does 150 miles every day (900 miles per week) so it is not unreasonable to expect him to average a six equivalent gallon fill-ups six times a week (36 equivalent gallon fill-ups per week) saving $10 each time. A $60 per week savings gives $3,000 a year (with two weeks off for vacation). So even if the equipment purchase price was $9,000 he could recover the cost in three years with only one natural gas vehicle. For small families with less driving, the recovery time would be proportionately longer and with large families with more driving the recovery time will be proportionally shorter. Applicant's expert has a "soccer mom" neighbor that drives 100 miles a day just taking kids to different schools and different after-school programs and doing a little real estate sales in between.

Nothing in the prior art suggests the present invention. The prior art does describe many designs for commercial CNG stations and these stations are currently being built throughout the world to take advantage of the current low cost of natural gas, but there is no suggestion in these designs to suggest the present invention as presently claimed. In addition there are a few home based stations in which a low-cost compressor is used to directly compress the compressed natural gas tank in a car, but these systems require about 8 hours for filling the tank. Applicant's station provides a low-cost station with a refueling time of less than one minute.

Although the above-preferred embodiments have been described with specificity, persons skilled in this art will recognize that many changes to the specific embodiments disclosed above could be made without departing from the spirit of the invention. For example, the six storage tanks could be replaced with a single CNG storage tank which could substantially reduce the initial cost of the station. Applicant expects that for his mass produced home refueling station, the storage facility will be spherical which could result in substantial cost savings as compared to the six K bottles. Therefore, the attached claims and their legal equivalents should determine the scope of the invention.

What is claimed is:

1. A home based natural gas refueling station for providing natural gas fuel to a vehicle, comprising:

a natural gas fill line connected to said home;

a multi-stage gas compressor connected to said natural gas fill line;

a filter on the natural gas fill line, a first pressure transducer upstream of the filter, and a second pressure transducer downstream of the filter and upstream of the multi-stage gas compressor;

a first pressure relief valve between the second pressure transducer and the multi-stage compressor;

a natural gas storage tank array, said storage tank array comprising a plurality of natural gas storage tanks, said plurality of natural gas storage tanks further comprising a frontmost storage tank;

a water trap connected to the natural gas storage tank array, the water trap including two solenoid valves;

a pressurized natural gas storage tank exit line directly connected to said frontmost storage tank, a second pressure relief valve on the pressurized natural gas storage tank exit line downstream of the natural gas storage tank array;

a drain valve downstream of the second pressure relieve valve;

a pressure selector switch downstream of the drain valve;

two pressure regulators arranged in parallel downstream of the pressure selector switch;

a fill nozzle connected to said exit line downstream of the two pressure regulators;

wherein as pressurized natural gas is depleted from said frontmost storage tank during fueling of a vehicle, said frontmost storage tank is simultaneously repressurized via other storage tanks in said natural gas storage tank array; and wherein the multi-stage gas compressor and the storage tanks are disposed in a shed along a driveway of said home.

2. The natural gas refueling station of claim 1, wherein said compressor is shut off during the refueling process.

3. The natural gas refueling station of claim 1, wherein said plurality of natural gas storage tanks are connected in series.

4. The natural gas refueling station of claim 1, wherein said plurality of natural gas storage tanks are connected in parallel.

5. The natural gas refueling station of claim 1, wherein said plurality of natural gas storage tanks are connected in series and connected in parallel.

6. The natural gas refueling station of claim 1, wherein the pressure selector switch is configured such that a user is able to select between 3000 psi and 3600 psi.

7. The natural gas refueling station of claim 1, wherein the multi-stage gas compressor is capable of pumping at a rate of at least 0.5 gallons per hour.

* * * * *